US005220708A

United States Patent [19]

Lucas et al.

[11] Patent Number: 5,220,708

[45] Date of Patent: Jun. 22, 1993

[54] SELF-TRIMMING SHIELD FOR A DOOR HEEL

[75] Inventors: Craig L. Lucas, Bureau County; Rex H. Lasson, Princeton, both of Ill.

[73] Assignee: Schlage Lock Company, San Francisco, Calif.

[21] Appl. No.: 862,656

[22] Filed: Apr. 1, 1992

[51] Int. Cl.[5] ..... E05D 1/00

[52] U.S. Cl. ..... 16/225; 16/250; 49/383

[58] Field of Search ..... 16/221, 225, 250; 49/383

[56] References Cited

U.S. PATENT DOCUMENTS

| | | | |
|---|---|---|---|
| 2,557,716 | 6/1951 | Allee | 16/250 |
| 2,641,792 | 6/1953 | Peeler | 49/383 |
| 2,681,480 | 6/1954 | Dixon, Sr. | 49/383 |
| 2,910,741 | 11/1959 | Dettman | 16/250 |
| 3,302,690 | 2/1967 | Hurd | 160/40 |
| 4,040,142 | 8/1977 | Ippolito | 16/250 |

FOREIGN PATENT DOCUMENTS

| | | |
|---|---|---|
| 531236 | 10/1956 | Canada . |
| 8501481 | 3/1985 | Netherlands . |
| 2019475A | 10/1979 | United Kingdom . |

*Primary Examiner*—W. Donald Bray
*Attorney, Agent, or Firm*—Robert F. Palermo

[57] ABSTRACT

A self-trimming shield for the gap between a hinged door heel and its casing, includes a unitary strip of length approximately equal to the height of the door and made up of a sequentially arrayed plurality of elongated parallel panels. Opposite end panels of the plurality are attached, respectively, to the door and casing on the side opposite the hinge, while inner panels of said plurality are articulably connected with the end panels and with each other in such manner that, when the door is closed, the panels automatically fold to lie in close proximity to the door so that the shield appears to be an integral part of the door trim.

5 Claims, 3 Drawing Sheets

SELF-TRIMMING SHIELD FOR A DOOR HEEL

BACKGROUND OF THE INVENTION

This invention relates generally to door safety devices and more particularly to safety and privacy shields for us at hinge pinch point openings of doors.

Such shields are well known and commonly used in both residential and commercial facilities. However, the known prior art shields are bulky, have a functional appearance which does not permit matching the shield to the surrounding door and frame trim, and may invert in use, become caught in the hinge pinch point, and thus become ineffective as shields.

In particular, it is known from the prior art to form hinge covers from one or two flexible or semi-rigid intermediate panels mounted between the door and casing. Flexible door hinge guards may lack the structural integrity to prevent entry of fingers into the pinch point area, but may serve merely as a reminder of the presence of the pinch point. Often, such guards are made from a rubber-like material which is unsuitable for painting or other common finishing operations.

In the case of semi-rigid or rigid panels, installation of two panel shields becomes critical, and it is virtually impossible to install them so that both panels of the shield are flush with the door and the door casing. The resulting gaps are unsightly, and the panels, standing out finlike from the door, do not blend with the door or casing. Thus, the shield becomes a prominent and unsightly feature, thereby limiting its use in architecturally coordinated residences or commercial buildings.

Partial or one-sided guards and shields are also known in the prior art. While these warn of danger, they do not totally prevent entry into the hinge pinch point area.

The foregoing illustrates limitations known to exist in present door heel gap safety and privacy shields. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a self-trimming shield for the gap between a hinged door heel and its casing including a unitary strip of a length substantially equal to the height of the door and having a plurality of elongated sequentially connected parallel end panels and inner panels, the opposing end panels of which being attached, respectively, to the door and the casing on the side opposite the hinge, inner panels of which being articulatably connected therewith and with each other in a manner such that when the door is closed, the panels automatically fold over each other to lay close against the surface of the door.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
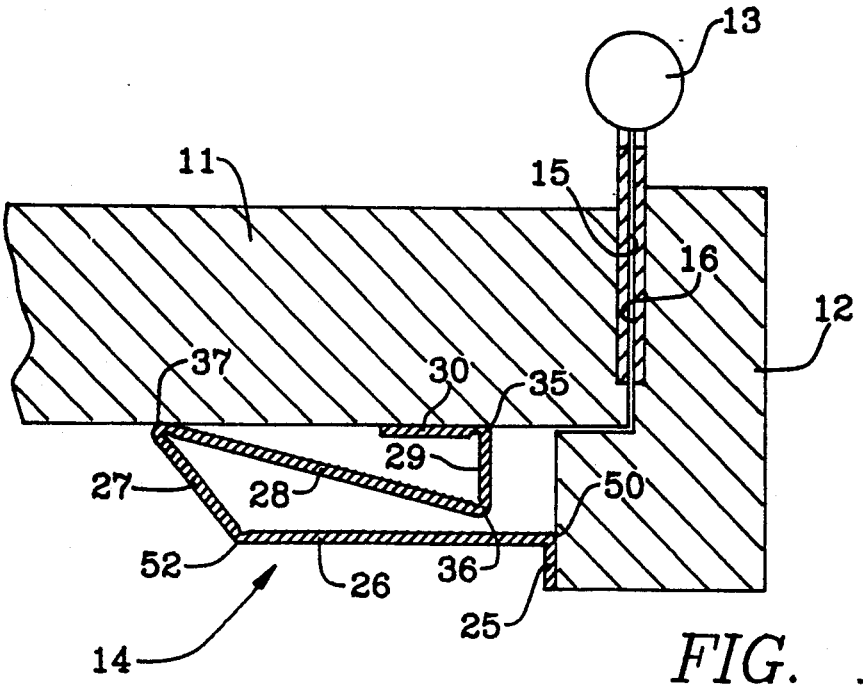
FIG. 1 is a vertical cross-sectional view illustrating a preferred embodiment of the self-trimming shield of the present invention.
Figure 2:
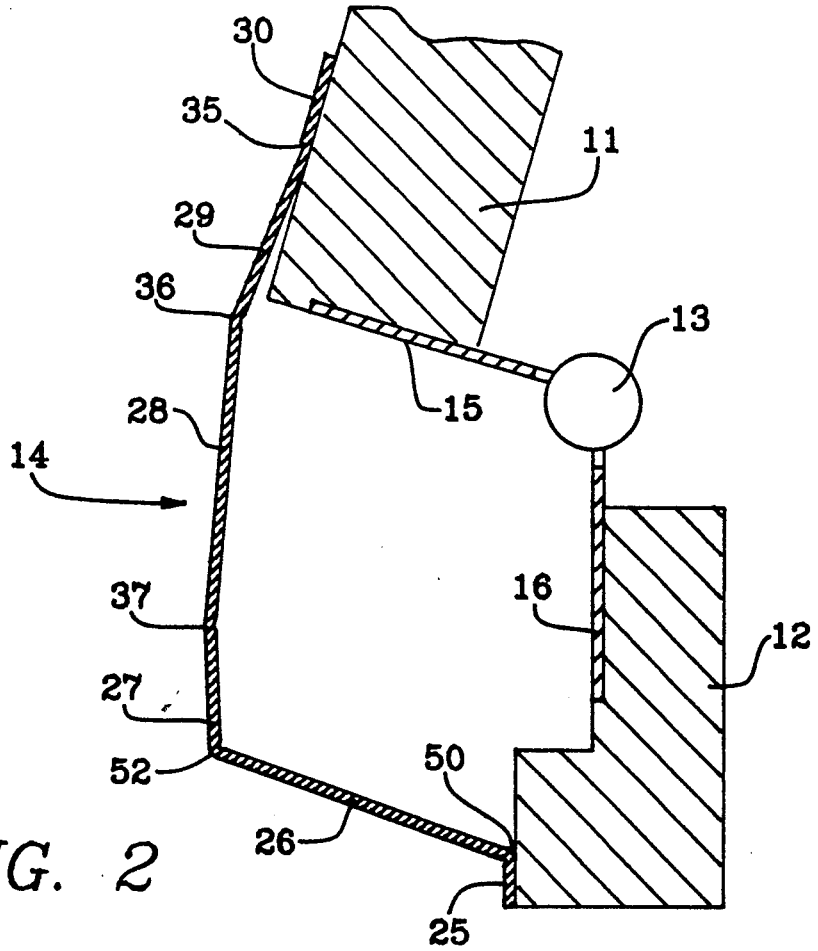
FIG. 2 is a view of the shield of FIG. 1 with the door in its open position.

FIGS. 1 and 2 present vertical sectional views of the preferred embodiment of this invention with the door in closed and open positions, respectively. Door 11 is mounted in casing 12 by means of hinges 13 as commonly seen. A pinch point is defined by the space between door heel 15 and casing jamb 16. The self-trimming shield 14 is designed to cover the pinch point and to exclude foreign objects in order to prevent damage to the door and possible injury to persons using the door.

Shield 14 is made up of end panels 25 and 30, attached to casing 12 and door 11, respectively. Inner panels 26, 27, 28, and 29 are sequentially connected to form a unitary strip which extends the full height of door 11. Joints 35, 36, 37, 52, and 50 are flexible to permit articulation between the panels of the shield 14. For easy stowing against door 11, joints 35, 36, and 37 have minimal resistance to articulation. Joints 52 and 50 are preferably formed with sufficient articulation resistance to provide a constant bias which urge panels 26 and 27 away from the pinch point formed between door heel 15 and casing jamb 16 and, thus, prevent inversion of the shield 14 during cycling of the door 11 between its open and closed positions.

Figure 5A:
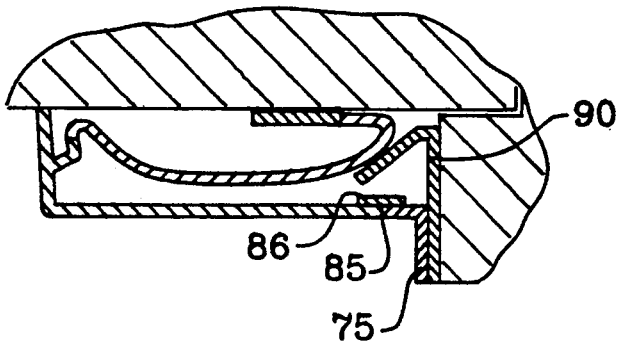
FIGS. 5*a* and 5*b* are fragmentary views of one embodiment of a separable biasing device for preventing inversion of the shield during cycling of the door between open and closed positions.
Figure 5B:
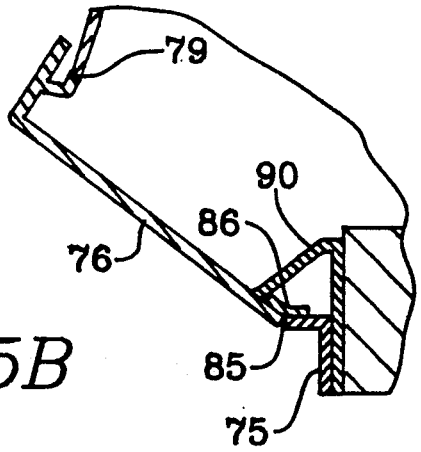

A separable biasing member 90, as illustrated in FIGS. 5*a* and 5*b*, would permit use of connections having virtually no resistance to articulation for the embodiments shown in either FIGS. 1 and 2 or FIGS. 5*a* and 5*b*. This separability presents the possibility of retrofitting doors having existing shields to provide those shields with inversion resistance. It is also feasible to integrally form a functional equivalent to this biasing device on the shield when making the shield, for example by extrusion. This option is not illustrated, since it merely requires merging of panel 75 with biasing member 90. The choice of method for providing biasing to the shield is primarily governed by the ease of fabrication and the mechanical properties of the shield material.

Figure 3:
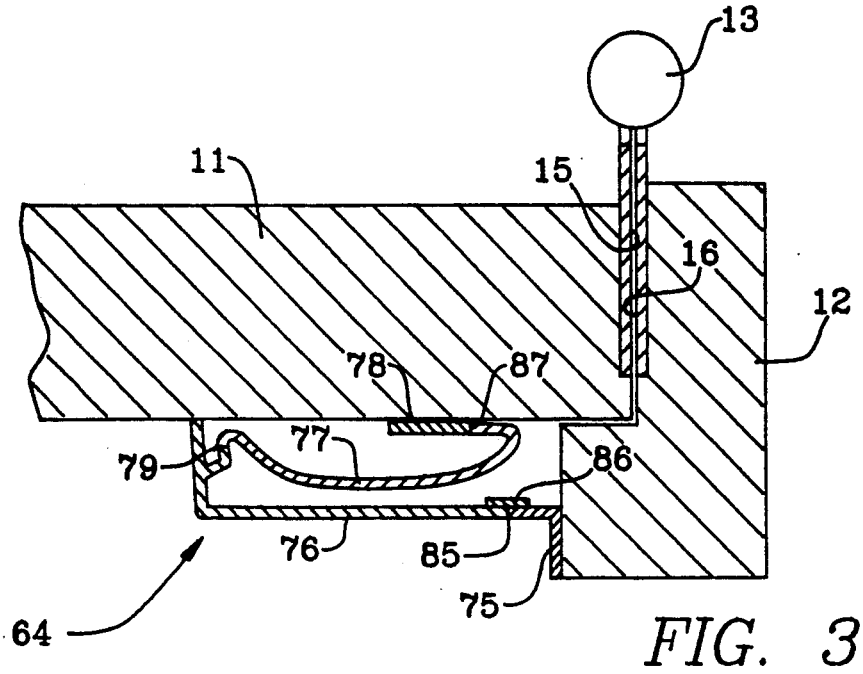
FIG. 3 is a vertical cross-sectional view of an alternative embodiment of the self-trimming shield.
Figure 4:
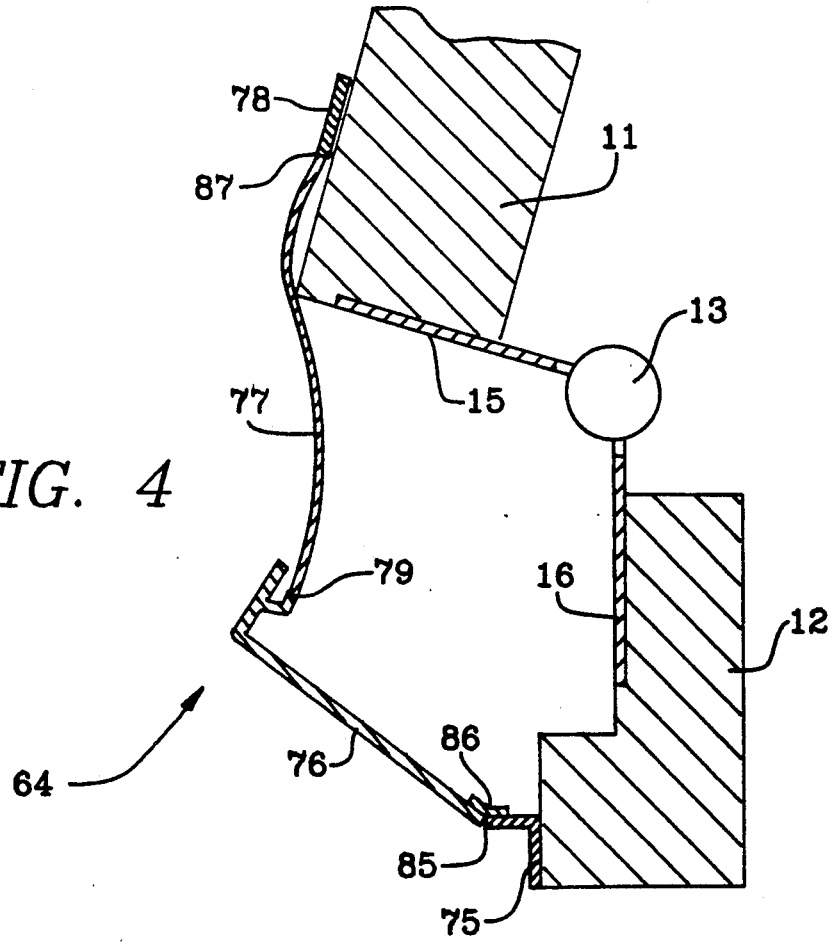
FIG. 4 is a view of the shield of FIG. 3 with the door in its open position.

Referring to FIGS. 3 and 4, another embodiment of the invention, shield 64, is shown with the door in the closed and open positions. End panels 75 and 78 are attached to door casing 12 and door 11, respectively. Inner panels 76 and 77 are connected to each other at joint 79 and to end panels 75 and 78 at joints 85 and 87, respectively. Panel 76 is essentially rigid, while panel 77 is soft and elastically flexible. Joint member 86 permits articulation between panels 75 and 76. It may be soft to provide minimal articulation resistance or resiliently stiff to provide the bias needed to prevent inversion of the shield.

According to the present invention, the dimensional proportions of the various panels described are chosen so as to form a self-trimming shield which harmonizes with the appearance of the door trim. It is also clear that the tendency of the shield to invert during cycling can be profoundly affected by the dimensional proportions of the panels. For example, if panel 26 of FIGS. 1 and 2 and panel 76 of FIGS. 3 and 4 are sufficiently wide, inversion of the shield is impossible without destructively deforming the panel. By incorporation of the biasing member, it is possible to satisfy the anti-inversion requirement while still maintaining the harmony of appearance which is esthetically important in most cases. The shield may be fabricated from combinations of rigid and flexible members or from flexurally similar components made from an appropriate semi-rigid polymeric material or other resilient material.

Attachment of end panels 25, 30, 75, and 78 may be by adhesive bonding, thermal bonding, mechanical fasteners, or other appropriate commonly known joining process.

In summary, the shield of the present invention provides a self-trimming device 14, or 64, which stows neatly against the door 11, as shown in FIGS. 1, 3, and 5*a*. This is accomplished using a plurality of relatively stiff panels. End panels 25, 30, 75, and 78 being fastened to door 11 and door casing 12 while inner panels 26, 27, 28, 29, 76, and 77, as they may apply, are articulably connected to the end panels and/or each other at joints 35, 36, 37, 52, 50, or 85, as appropriate. Anti-inversion bias may be provided by making joints 50 and 52 or joint member 86 with sufficient elastic stiffness to resist entry of panels 26, 27, 28, or 76, as the case may be, into the pinch point defined by the gap between door heel 15 and casing jamb 16. An alternative biasing member 90 is provided either as a separable item, as illustrated in FIGS. 5*a* and 5*b*, or as an integrally formed part of the shield panel as described above. When the door is opened, as seen in FIGS. 2, 4, and 5*b*, the shield 14 or 64 unfolds to cover the pinch point. In its separable embodiment, biasing member 90 may have only a short vertical extent when used with a shield having sufficient stiffness. The biasing member, in whichever embodiment employed, urges inner panels 26, 27, and 76 away from the pinch point to prevent inversion of the shield.

If desired, the shield may be provided with an attachment concealing feature (not illustrated) by merely changing the direction of panel 25 or 75, as applicable, during fabrication of the shield. This locates the fasteners or other attachment means under the panels 26 and 27 or 76 when the door is closed.

The foregoing invention has been illustrated and described in accordance with a preferred embodiment. It is recognized that other variations and changes may be made therein without departing from the invention as set forth in the claims.

Having described the invention, what is claimed is:

1. A self-trimming shield for the gap between a hinged door heel and its casing, comprising:

a unitary strip of length substantially equal to the height of said door and comprising a sequentially arrayed plurality of elongated parallel end panels and inner panels; opposite end panels of which plurality being attached, respectively, to the door and casing on the side opposite the hinge; and inner panels of said plurality being articulably connected with said end panels and with each other in such manner that, when the door is closed, said panels automatically fold to lie in close proximity to the door.

2. The self-trimming shield of claim 1, wherein said unitary strip comprises at least five panels.

3. The self-trimming shield of claim 2, wherein said panels have sizes and configurations which prevent inversion of said shield when the door is fully cycled between its opened and closed positions.

4. The self-trimming shield of claim 1, further comprising:

means, on at least one of said plurality of panels, for biasing said inner panels away from the door heel when the door is being opened and closed.

5. The self-trimming shield of claim 1, wherein one or more of said plurality of panels are configured in such a way that said shield appears to be part of the door trim when the door is closed.

* * * * *